US007128223B1

(12) United States Patent
Sarnoff et al.

(10) Patent No.: US 7,128,223 B1
(45) Date of Patent: Oct. 31, 2006

(54) MERCHANDISE SHELVING ASSEMBLY

(75) Inventors: Norton Sarnoff, Northbrook, IL (US); Richard McCornick, Vernon Hills, IL (US); Theresa Rauch, Elgin, IL (US)

(73) Assignee: Handi-Foil Corporation, Wheeling, IL (US)

( * ) Notice: Subject to any disclaimer, the term of this patent is extended or adjusted under 35 U.S.C. 154(b) by 99 days.

(21) Appl. No.: 10/972,917

(22) Filed: Oct. 25, 2004

(51) Int. Cl.
*A47H 1/00* (2006.01)

(52) U.S. Cl. ..... 211/90.03; 211/103; 211/106; 248/228.3; 248/245; 248/292.14

(58) Field of Classification Search ..... 211/103, 211/90.03, 54.1, 57.1, 59.1, 106; 248/222.51, 248/220.43, 245, 228.3, 292.14, 227.13
See application file for complete search history.

(56) References Cited

U.S. PATENT DOCUMENTS

| | | | | | |
|---|---|---|---|---|---|
| 0,857,543 | A | | 6/1907 | Thomas | |
| D115,255 | S | | 6/1939 | Taylor | |
| 3,294,351 | A | | 12/1966 | Rollins | |
| 3,565,381 | A | | 2/1971 | Oliver | |
| 3,595,404 | A | * | 7/1971 | Goldstein et al. | 211/29 |
| 3,627,247 | A | * | 12/1971 | Krikorian | 248/243 |
| 3,730,108 | A | | 5/1973 | Stroh | |
| 3,993,002 | A | * | 11/1976 | Stroh | 108/108 |
| 4,036,369 | A | * | 7/1977 | Eisenberg | 211/88.02 |
| 4,205,815 | A | | 6/1980 | Sauer | |
| 4,248,352 | A | * | 2/1981 | White | 211/88.01 |
| 4,511,047 | A | * | 4/1985 | Elinsky | 211/90.03 |
| 4,620,489 | A | | 11/1986 | Albano | |
| 4,678,151 | A | | 7/1987 | Radek | |
| 4,805,863 | A | | 2/1989 | Armstrong | |
| 4,813,535 | A | * | 3/1989 | Radocha et al. | 206/738 |
| 5,063,715 | A | | 11/1991 | Goodman | |
| 5,397,087 | A | * | 3/1995 | Teece | 248/220.42 |
| 5,449,076 | A | * | 9/1995 | Van Noord | 211/59.3 |
| D365,947 | S | * | 1/1996 | Howard | D6/470 |
| 5,482,168 | A | | 1/1996 | Welch | |
| 5,868,263 | A | | 2/1999 | McAllister | |
| 6,070,841 | A | | 6/2000 | Robinson | |
| 6,161,708 | A | * | 12/2000 | Myler | 211/90.02 |
| 6,168,125 | B1 | * | 1/2001 | Winger et al. | 248/228.3 |
| 6,315,258 | B1 | | 11/2001 | Myler | |
| 6,481,678 | B1 | | 11/2002 | Chong | |
| 6,702,128 | B1 | | 3/2004 | Winig | |
| 6,726,035 | B1 | * | 4/2004 | Zadak | 211/90.03 |

* cited by examiner

*Primary Examiner*—Richard E. Chilcot, Jr.
*Assistant Examiner*—Lindsay M. Maguire
(74) *Attorney, Agent, or Firm*—Adam K. Sacharoff; Much Shelist

(57) ABSTRACT

A shelf assembly for use with a display rack is provided. The display rack has two lateral posts, each of which has a plurality of vertically spaced openings. The shelf assembly includes a shelf, a pair of braces and a clip corresponding to each brace. The braces and clips are capable of supporting the shelf at a predetermined height above the uppermost vertical spaced opening in the lateral post such that the shelf assembly is able to display articles higher than typical shelf assemblies. The braces may also be lowered such that the braces overlaps the shelving structure below thereto.

6 Claims, 4 Drawing Sheets

MERCHANDISE SHELVING ASSEMBLY

BACKGROUND OF THE INVENTION

The present invention relates to a merchandise shelving display and more particularly to a shelving assembly that utilizes space above the prior art shelving displays to provide extra shelving space that was not previously available.

Various types of merchandise displays have been available. Some of these prior art merchandise displays further relate to extending the area of display in order to stack more merchandise. U.S. Pat. No. 4,620,489 discloses an extendible merchandise shelving display that includes a shelf that extends to increase the overall width (or direction from the display rack). Other merchandise displays are simply drawn to different overall structures or mounting brackets (brackets used to mount the shelf to the display rack). U.S. Pat. No. 3,730,108 discloses an adjustable shelving structure that includes vertical upright posts with a peg board placed in between the vertical upright posts. The shelves are mounted directed to the upright posts. U.S. Pat. No. 3,294,351 similarly discloses a shelf mounted directly to upright posts. U.S. Pat. No. 6,315,258, however, utilizes the peg board to mount brackets, wherein the merchandise or shelves are mounted directly to the peg board.

Close review of these and other prior art references finds that the shelf or basket are always leveled with or held relatively even with the bracket. As such, the shelf or basket holding the merchandise cannot extend higher than the shelving structure that includes the vertical upright posts nor higher then the peg board. There is thus a large area of the shelving display above the uppermost shelf that is not been used in the industry. Since each additional shelf provides a greater display area that allows the merchant to sell more goods, it is extremely beneficial to increase the area. The invention should also be adaptable to fit into existing shelving displays without compromising the existing display area.

SUMMARY OF THE INVENTION

In accordance with the present invention a shelf assembly for use with a display rack is provided. The display rack has two lateral posts, each of which has a plurality of vertically spaced openings. The shelf assembly includes a shelf, a pair of braces and a clip corresponding to each brace. An important aspect of the present invention is that the braces and clips are capable of supporting the shelf at a predetermined height above the uppermost vertical spaced opening in the lateral post. This permits the shelf assembly to display articles higher than typical shelf assemblies. Another aspect of the present invention permits the brace to be lowered such that the brace overlaps the shelving structure below thereto, where the lower shelving structure is a typical prior art shelf.

These aspects of the present invention are accomplished by the present invention which includes a shelf with a flat bottom, a shallow front portion, and a back portion that is significantly longer than the front portion. The front portion and back portion also extend upwardly away from the flat bottom.

In addition, each brace has a lateral section with openings and an arm secured at one end to the lateral section and secured at another end to the shelf. Lastly, each clip includes a mounting bracket that has an outside face secured to the lateral section of the brace. The clip also has a mounting face that includes means to secure the clips to the lateral posts. The mounting face is perpendicular to the outside face and includes a predetermined depth such that the braces are secured at a predetermined distance away from the lateral posts.

The clips may also include a locking bracket that is slidably engaged to an inside portion defined on the mounting bracket. The locking bracket has a secondary means to lock the clips to the lateral posts. Thereby the shelf assembly cannot be accidentally knocked off of the lateral posts.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
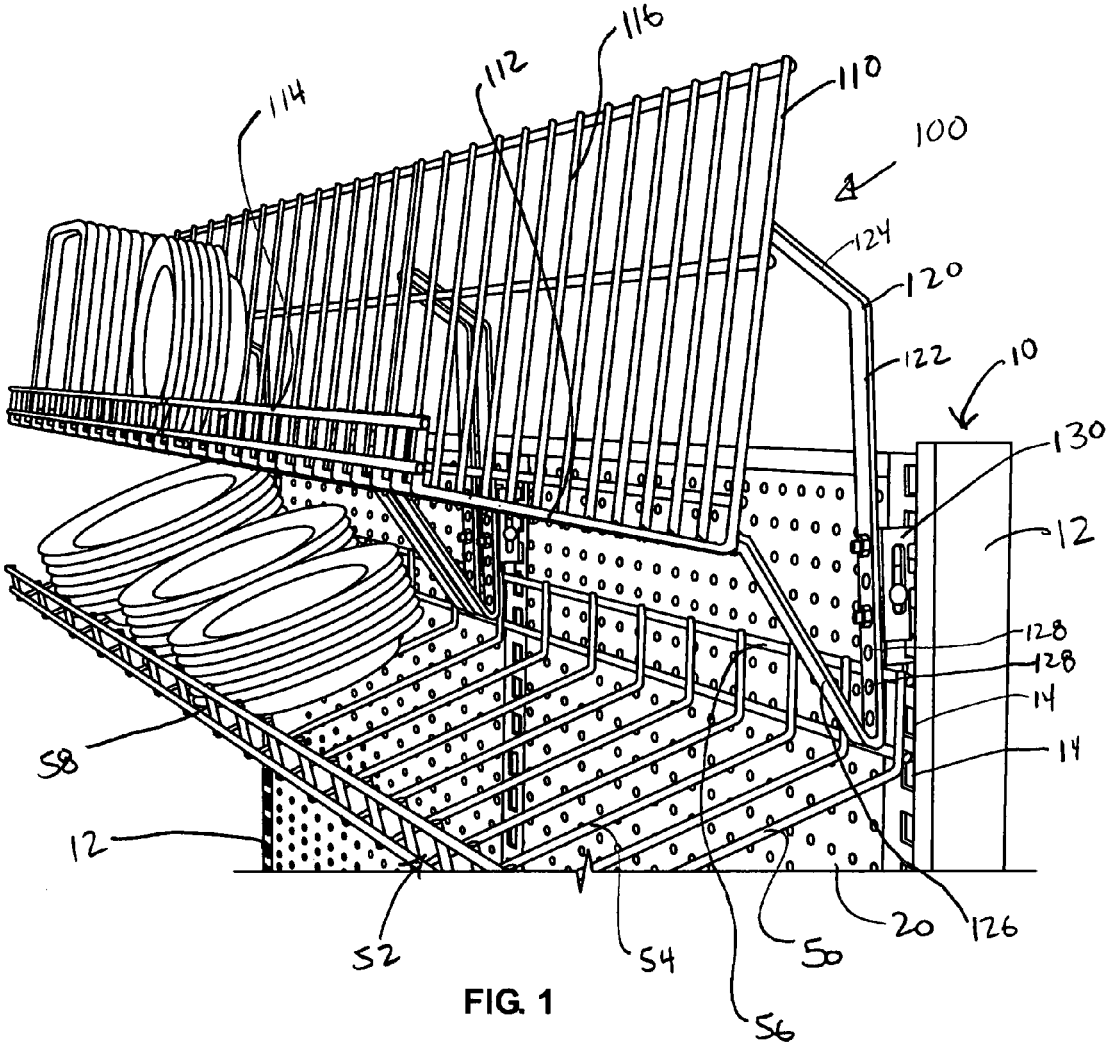
FIG. 1 is a perspective view of a shelf assembly in accordance with the present invention, the shelf assembly is attached to a display rack, FIG. 1 further illustrates a prior art shelf below the invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 3:
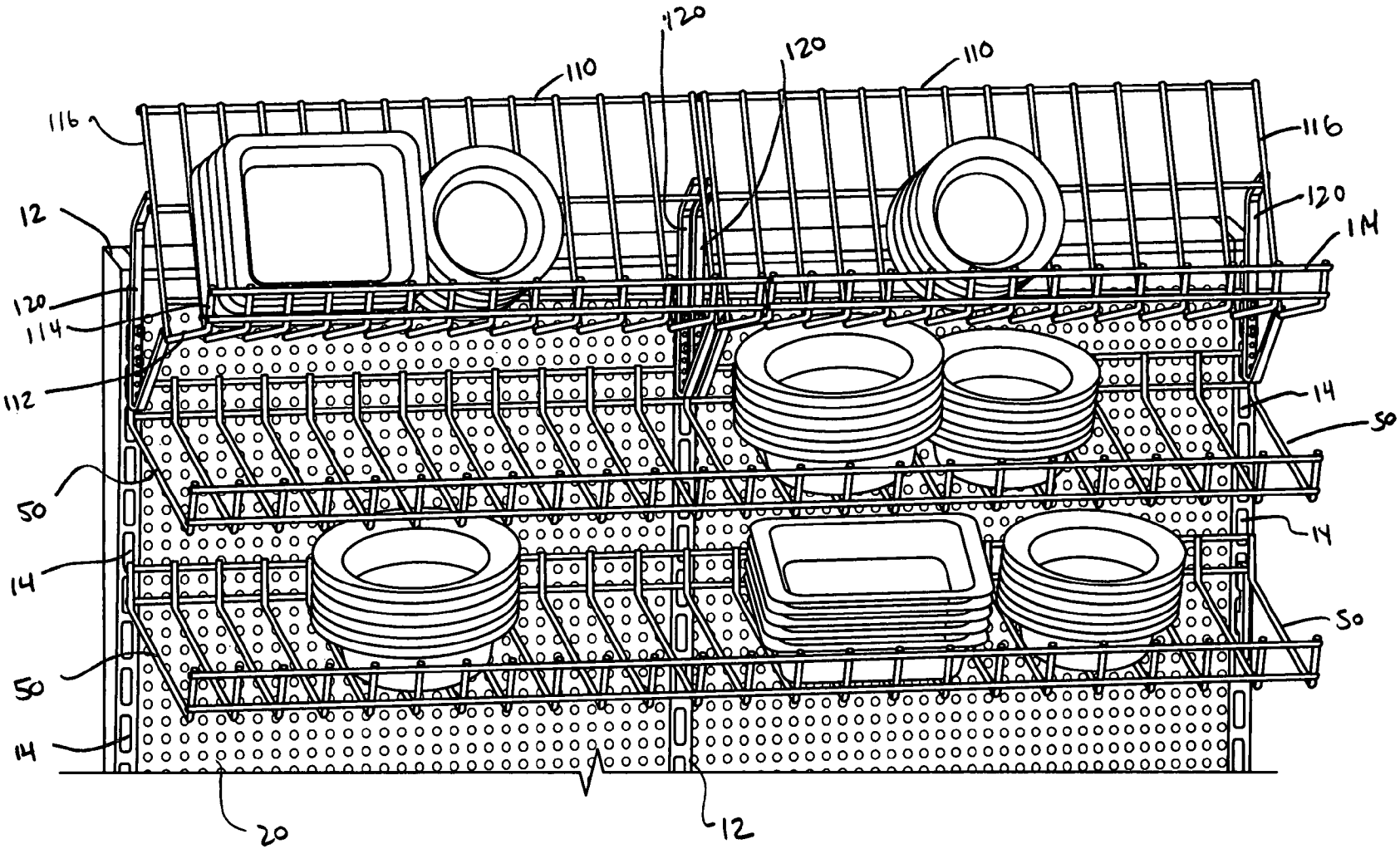
FIG. 3 is front perspective view of the shelf assembly from FIG. 1.
Figure 4:
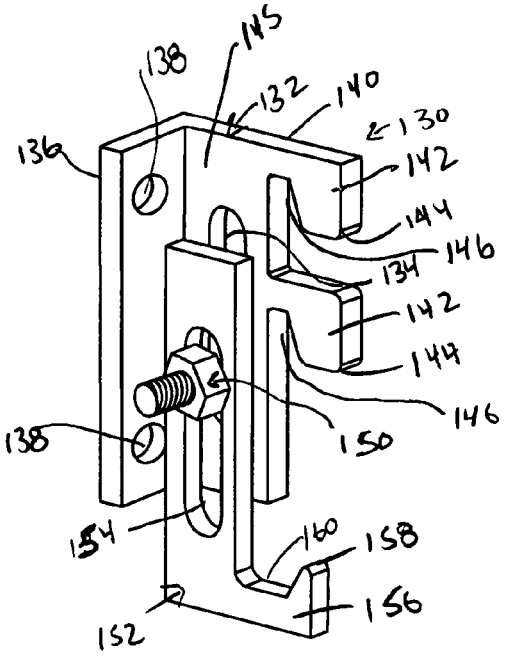
FIG. 4 is an inside perspective view of the clip illustrated in FIG. 2.
Figure 5:
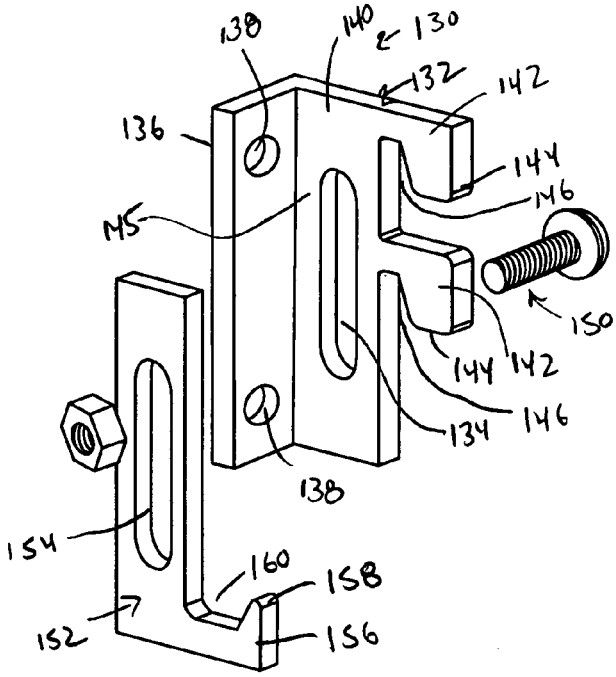
FIG. 5 is an exploded view of the clip from FIG. 4.
Figure 6:
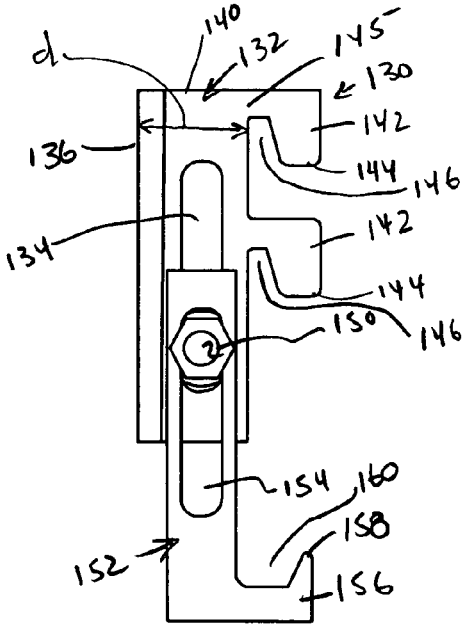
FIG. 6 is an left side view of the clip from FIG. 4.
Figure 7:
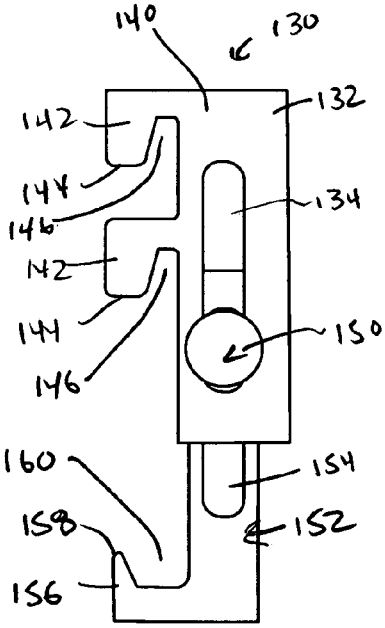
FIG. 7 is a right side view of the clip from FIG. 4.

Referring now to FIGS. 1 and 3, a partial perspective view of a shelf assembly 100 in accordance with the present invention is illustrated. The assembly 100 is secured to a display rack 10 (known in the art) that includes a common and well-known shelf 50.

The display rack 10 includes a plurality of spaced apart upright posts 12. Each post 12 includes a number of vertical spaced openings 14. A pegboard 20 is provided between the posts 12. As well known in the art, shelves 50 are secured to the pegboard 20. The typical shelf 50 used on the display rack 10 is formed of a generally U-shaped outer frame 52 inasmuch as the outer frame 52 has a flat bottom 54 with a low back portion 56 and a shallow front portion 58 bent upwardly to form a retainer for articles positioned on the shelf 50. The outer frame 52 is generally fabricated from relatively heavy gauge wire. The back portion 56 is low because the shelf 50 is positioned up against the pegboard 20 such that articles positioned on the shelf and against the back portion 56 will not fall off the shelf. Multiple shelves 50 are typically positioned on the display rack at various heights such that numerous articles can be displayed. In addition, a predetermined amount of space must be provided between shelves 50 in order to provide the consumer with the ability to look and retrieve the articles. Therefore, because of these factors, only a specific number of shelves 50 are able to fit on the display rack. There is thus a need to provide a shelf assembly that can be used above these shelves without interfering with the articles thereon; thereby providing the merchant with another shelf to display articles.

The shelf assembly 100 includes a shelf 110, a brace 120, and a clip 130. While the shelf 110 is designed to retain articles, it is shaped differently then the prior art shelves 50. The shelf 110 includes a flat bottom 112, a shallow front portion 114, and a high back portion 116. The high back portion 116 is preferably significantly longer than the low back portion 56 on a typical shelf 50. As discussed in greater detail below, the shelf 110 does not rest against the peg board 20, therefore a higher or longer back portion is required to prevent articles resting in the shelf 110 from falling out behind the shelf 110. The flat bottom 112 is shorter than the typical flat bottom 54 in order to have the front portions of both the present invention 100 and the prior art shelves 50 extend out the to about the same distance. However, the front portion of the present invention may be recessed or extend out past the prior art shelf that is positioned below the present invention. The high back portion 116 of the shelf 110 also permits articles to be arranged such that the articles are resting up against the high back portion 116 as opposed to only resting on the flat portion (as illustrated in FIGS. 1 and 3).

To provide the shelf 110 of the present invention with the extra height and extension, the brace 120 is manufactured specifically to accomplish this task. The brace 120 includes a lateral section 122 that is secured to the clip 130. Extending from the lateral section 122 is at least one and preferably two forward extending arms, a top extending arm 124 and a lower extending arm 126. The extending arms 124, 126 are positioned to raise the shelf 110 to a position that is higher than the position that the assembly 100 is secured to the lateral posts 12. If desired, the position of the shelf 110 could be above the top portion of the lateral posts 12. The lateral section 122 includes a plurality of openings 128 to secure the lateral section 122 to the clip 130. The plurality of opening 128 permits adjustability of the brace 120 to the clip 130. Therefore, the height and distance between the uppermost typical shelf 50 and the present invention shelf 110 can be easily adjusted.

Figure 2:
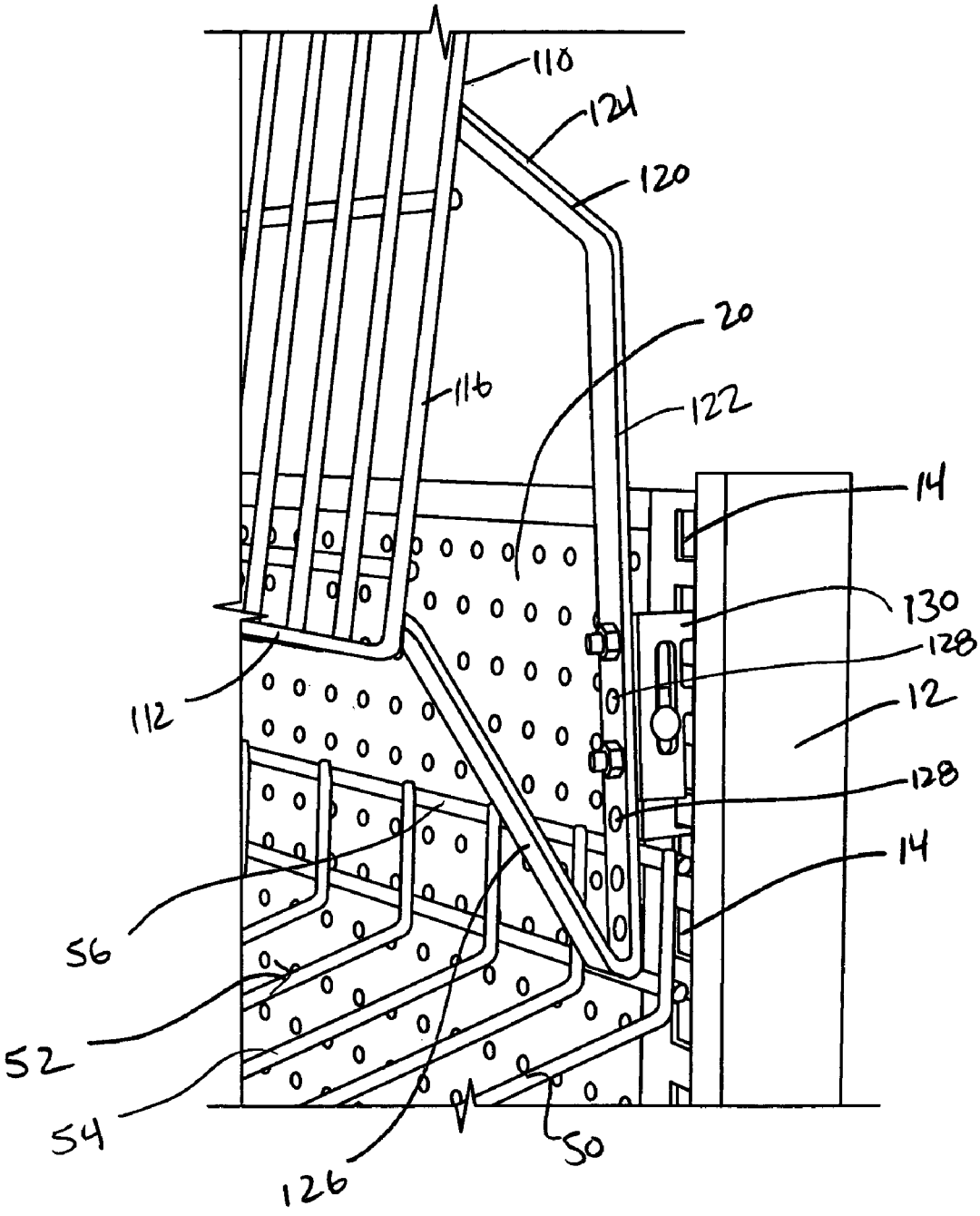
FIG. 2 is an enlarged perspective view of the brace and clip of the shelf assembly from FIG. 1.

As shown in FIGS. 1 and 2, the lateral section 122 is also positioned away from the lateral post such that the lower end of the lateral section 122 can overlap the low back portion 56 of the shelf 50. This feature is accomplished by the unique clip 130 specifically designed for the shelf assembly 100.

The clip 130 shown in great detail in FIGS. 4 through 7 is herein discussed. The clip 130 includes a mounting bracket 132 and a locking bracket 152. Both the mounting bracket 132 and the locking bracket 152 include a longitudinal slot (134 and 154 respectively). The two slots 134 and 154 align with each other when the two brackets are assembled. The two brackets 132 and 152 are fastened to each other by a typical screw and nut combination 150. Upon loosening the fastening 150 the locking bracket 152 may slide with respect to the mounting bracket 132 (and visa versa).

The mounting bracket 132 includes an outside face 136 that abuts the lateral section 122 of the brace 120. The outside face 136 includes at least one opening 138 (preferably two) that are able to align with the openings 128 on the lateral section 122. The lateral section 122 is secured to the outside face 136 with similar fastenings 150 (as described above). The mounting bracket 132 also includes a mounting face 140 that extends at a perpendicular angle from the outside face 136. The mounting face 140 includes a pair of flanges 142 with a downwardly projecting hook portion 144 provided with an inner notch 146. The flanges 142 are vertically spaced from each other a distance equal to the vertical spacing of adjacent openings 14 defined on the posts. The mounting bracket 132 may then be mounted on the upright posts 12 at a desired vertical position by inserting the pair of flanges 142 through a pair of adjacent openings 14.

The locking bracket 152 is placed against the inside portion 145 on the mounting bracket 132 and positioned such that its slot 154 is aligned with the slot 134 on the mounting face 140. The locking bracket 152 includes a flange 156 with an upwardly projecting hook portion 158 also provided with an inner notch 160. The locking bracket 152 slides with respect to the mounting bracket 132 until the flange 156 can be properly inserted in one of the vertical openings 14 on the posts. Once the flange 156 on the locking bracket 152 is inserted into an opening 14 on the post 12, the locking bracket 152 is fastened to the mounting bracket 132, thereby locking the mounting bracket 132 to the vertical post 12.

Another important aspect of the invention is the clip 130 has an outside face 136 perpendicular to the mounting face 140 and the mounting face 140 has a predetermined depth d. When the shelf assembly 100 is assembled, the brace 120 is mounted to the outside face 136 and the mounting face 140 mounts the brace 120 to the display rack 10 about an inch distance thereto. (It is important to note that the specific distance in which the mounting face 140 is mounted to the display rack 10 may be changed without affecting the entire scope of the invention.) Since the brace 120 is not abutting the lateral posts 12, the brace 120 may be lowered such that the lower extending arm 126 overlaps the shelf 50 immediately below thereto (illustrated in FIGS. 1–3).

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

The invention claimed is:

1. A shelf assembly for use with a display rack, the display rack having two lateral posts, each post having with a plurality of vertically spaced openings, a peg board secured between the lateral posts, and a secondary shelf unit secured to the peg board, the shelf assembly being secured above the secondary shelf unit and comprising:

a shelf having a flat bottom, a shallow front portion, and a back portion that is longer than the front portion, the front portion and back portion extend upwardly away from the flat bottom;

a pair of braces, each brace having a lateral section with openings and having an arm secured at one end to the lateral section and secured at another end to the shelf; and a clip corresponding to each brace, each clip having a mounting bracket that includes an outside face that has openings that align with the openings defined on the lateral section of the brace and the mounting bracket includes a mounting face that includes means to secure the clips to the lateral posts, the mounting face is perpendicular to the outside face and includes a predetermined depth such that the braces are secured at a predetermined distance away from the lateral posts, whereby the braces are able to overlap the secondary shelf unit secured thereunder.

2. The shelf assembly of claim 1, wherein the securing means defined by each mounting face includes a pair of downwardly projecting hook portions that engage the openings of the vertically spaced openings defined on the lateral posts.

3. The shelf assembly of claim 2, wherein each clip further includes a locking bracket slidably engaged to the mounting bracket, the locking bracket has an upwardly projecting hook portion that engages an opening of the vertically spaced openings defined on the posts, the locking means is slid to a position that permits the upwardly projecting hook portion to engage said opening of the vertically spaced openings on the lateral posts.

4. The shelf assembly of claim 1, wherein the arm on the lateral section extends upwardly and forwardly away from the lateral section at an angle such that the flat bottom portion of the shelf can be positioned at a predetermined height above where the clip is secured to the lateral posts.

5. A clip for mounting a brace that is secured to a shelf to display rack, the display rack having two lateral posts, each post having with a plurality of vertically spaced openings, the clip comprising:

a mounting bracket that includes a vertically aligned outside face that is secured to the brace and includes a mounting face that has a top vertically aligned flange with a downwardly projecting hook portion that engages into an opening of the plurality of vertically spaced openings defined on the lateral posts, and wherein the mounting face is perpendicular to the outside face and includes a predetermined horizontal depth such that the brace is secured at a predetermined distance away from the lateral posts; and a locking bracket slidably engaged in a vertical position to an inside portion defined on the mounting face, the locking bracket has a bottom vertically aligned flange with an upwardly projecting hook portion that engages into an opening of the plurality of vertically spaced openings defined on the lateral posts.

6. The clip of claim 5, wherein the mounting face includes an intermediate vertically aligned flange with a downwardly projecting hook portion that engages into an opening of the plurality of vertically spaced openings defined on the lateral posts and said intermediate flange being positioned between said top flange and said bottom flange.

* * * * *